US005740579A

United States Patent [19]

Fassler

[11] Patent Number: 5,740,579

[45] Date of Patent: Apr. 21, 1998

[54] BRUSH FOR IMPROVED TUFT RETENTION AND ANCHOR WIRE THEREFOR

[75] Inventor: Manfred Fassler, Morristown, Tenn.

[73] Assignee: Anchor Advanced Products, Inc., Morristown, Tenn.

[21] Appl. No.: 846,952

[22] Filed: Apr. 30, 1997

Related U.S. Application Data

[63] Continuation of Ser. No. 489,607, Jun. 12, 1995, abandoned.

[51] Int. Cl.[6] ..... A46B 3/16

[52] U.S. Cl. ..... 15/190; 15/167.1; 15/199; 15/204

[58] Field of Search ..... 15/190, 167.1, 15/194, 199, 195, 204

[56] References Cited

U.S. PATENT DOCUMENTS

| | | | |
|---|---|---|---|
| 423,506 | 3/1890 | Young | 15/190 |
| 788,714 | 5/1905 | Flemming | 15/190 |
| 1,828,422 | 10/1931 | Levy | 15/190 |
| 1,879,103 | 9/1932 | Connor | 15/190 |
| 2,289,313 | 7/1942 | Cave | 15/199 |
| 2,303,470 | 12/1942 | Jobst | 15/190 |
| 2,409,490 | 10/1946 | Jobst | 15/190 |
| 3,277,510 | 10/1966 | Peloquin | 15/195 |
| 3,430,281 | 3/1969 | Baumgartner . | |
| 3,562,835 | 2/1971 | Baumgartner . | |

FOREIGN PATENT DOCUMENTS

| | | | |
|---|---|---|---|
| 0299941 | 8/1932 | Italy | 15/190 |
| 0005143 | of 1911 | United Kingdom | 15/190 |

*Primary Examiner*—David Scherbel
*Assistant Examiner*—James F. Hook
*Attorney, Agent, or Firm*—Godfrey & Kahn, S.C.; Adam L. Brookman

[57] ABSTRACT

A brush with improved tuft retention having a handle, a head made from a flowable material, connected to the handle, having a plurality of tuft holes therein, with at least one bristle anchored in each tuft hole with a multi-sided staple. Each staple has a plurality of grooves in at least one side and the grooves in the staples are transverse to the longitudinal axis of the bristles when the staple is used to anchor bristles in a tuft hole.

20 Claims, 2 Drawing Sheets

BRUSH FOR IMPROVED TUFT RETENTION AND ANCHOR WIRE THEREFOR

This application is a continuation division of application Ser. No. 08/489,607, now abandonded filed Jun. 12, 1995.

FIELD OF THE INVENTION

The present invention relates generally to brushes and more particularly, to a brush exhibiting improved tuft retention by use of a grooved anchor wire.

BACKGROUND OF THE INVENTION

Brushes come in thousands of shapes and forms for use in millions of different jobs. In situations where bristles are subject to "snagging" the ability of the brush to retain its bristles is important not only for the life of the brush, but for the subject of the brush application.

Toothbrushes are specialized brushes used in the maintenance of dental hygiene. When used properly, a toothbrush removes food particles and plaque from teeth, thereby decreasing the occurrence of cavities, gingivitis, and other dental problems. FIG. 1 illustrates a conventional toothbrush, which comprises a handle and a head. The head is formed with a plurality of tuft holes arranged in rows. Extending out of each tuft hole is a plurality of bristles forming a tuft, with each tuft conventionally anchored by a flat anchor wire.

FIG. 2 is cross-sectional view of the head of a conventional toothbrush showing the tufts anchored in the tuft holes. As FIG. 2 illustrates, individual bristles are grouped together to form a tuft, looped (or bent in half) around a piece of anchor wire called a staple. The staple is driven into the tuft hole bringing the loop of the tuft to rest against the bottom of the tuft hole. The staple is actually slightly wider than the tuft hole and thus is held in place by the plastic surrounding the tuft hole. FIG. 3 shows a cross-sectional view, magnified 100×, of a typical anchor wire that is used to anchor the tufts in the tuft hole as shown in FIG. 2. As can be seen, the anchor wire has a rectangular cross-section with no variation.

When brushes are used, the staple acts to resist the removal of the tufts from the tuft holes that would otherwise occur when the tufts are scrubbed against or snagged against an object. Under most normal circumstances, the staples' retention strength is sufficient to keep the tufts in the tuft holes throughout their period of use. Nevertheless, in certain situations, such as when the tufts are scrubbed against teeth that are affixed with braces, snagged in cracks or otherwise captured, tufts can be pulled out of the tuft holes. Obviously, this is a problem for the user and the provider.

SUMMARY OF THE INVENTION

It is therefore an object of the present invention to provide a brush that overcomes the disadvantages exhibited by prior art brushes.

Another object of the present invention is to provide a brush with an anchor wire in which one side of the wire is longitudinally grooved.

A further object of the invention is to provide a brush with an anchor wire in which two sides of the wire are longitudinally grooved.

Still another object of the present invention is to provide a brush with an anchor wire in which both sides of the anchor wire are longitudinally grooved with the grooves of one side offset a predetermined distance relative to the grooves of the other side.

Various other objects, advantages and features of the present invention will become readily apparent from the ensuing detailed description.

BRIEF DESCRIPTION OF THE DRAWINGS

The following detailed description, given by way of example and not intended to limit the present invention, will best be understood in conjunction with the accompanying drawings in which.

DETAILED DESCRIPTION

Figure 1:
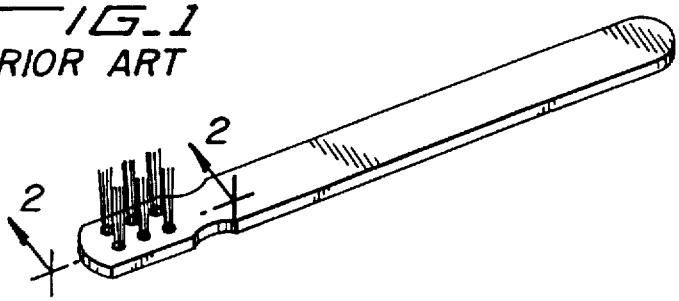
FIG. 1 PRIOR ART
FIG. 1 is a perspective view of a toothbrush.
Figure 2:
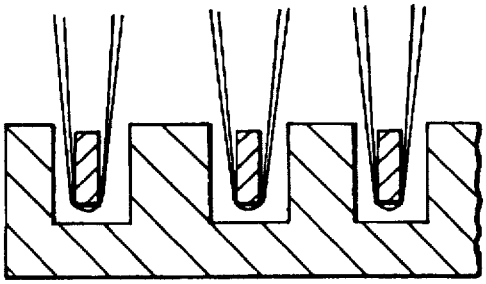
FIG. 2 PRIOR ART
FIG. 2 is a cross-sectional view of the head of a toothbrush showing staples anchoring tufts in the tuft hole of a toothbrush taken along line A—A of FIG. 1.
Figure 3:
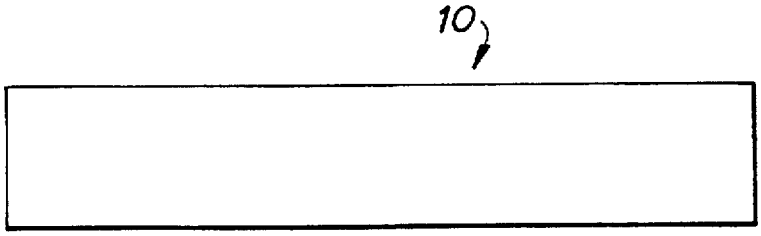
FIG. 3 PRIOR ART
FIG. 3 is a cross-sectional view of prior art anchor wire used to affix the tufts of FIG. 2.
Figure 4:
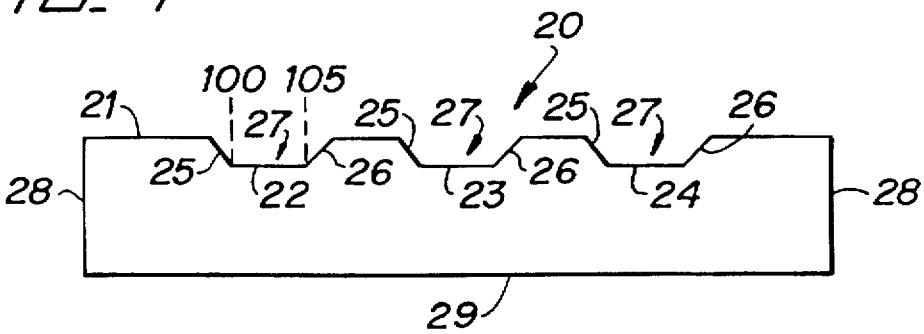
FIG. 4 is a cross-sectional view of one embodiment of an anchor wire of the present invention.

As shown in FIGS. 4–8, an anchor wire of the present invention has a plurality of longitudinal grooves formed in at least one surface of the wire. As shown in FIG. 4, a first embodiment of an anchor wire 20 of the present invention has longitudinally extending grooves cut into the "top" surface 21. The wire is preferably a nickel-silver alloy, but may be manufactured from other, rigid non-corrosive materials. In its preferred form, anchor wire 20 is 0.0600" wide, and 0.0100" thick. The top surface 21 of anchor wire 20 has 3 grooves 22, 23, and 24. Each groove comprises three sides: preferably the bottom 27 of each groove is 0.0060" wide and located 0.0020" below the top 21 of anchor wire 20; the left side 25 of each groove is inclined 45° in a counterclockwise direction from the bottom 27 of each groove (shown by the dotted line 100); and the right side 26 of each groove is inclined 45° in a clockwise direction from the bottom 27 of each groove (shown by the dotted line 105). The tops of sides 25 and 26 are each preferably 0.0100" apart. The center of outer grooves 22 and 24 are each spaced 0.0150" from the sides 28 of anchor wire 20, and the center of middle groove 23 is spaced 0.0300" from the sides 28 of anchor wire 20.

Figure 5:
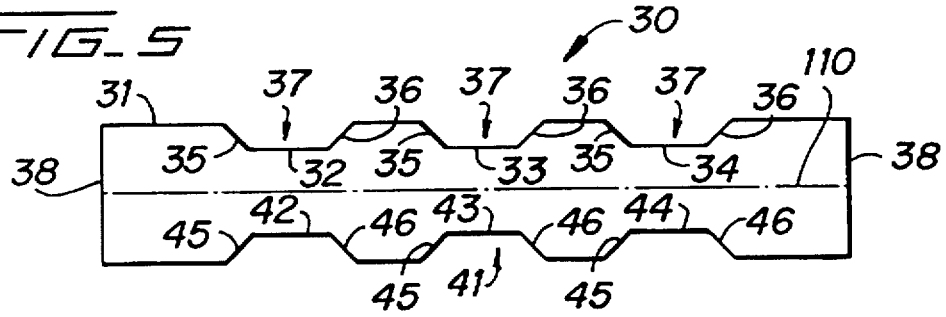
FIG. 5 is a cross-sectional view of another embodiment of an anchor wire of the present invention.

As shown in FIG. 5, in another embodiment of the present invention anchor wire 30 has longitudinal grooves formed in both the top and bottom surfaces. The top 31 of anchor wire 30 includes three grooves 32, 33, and 34 that have been formed in accordance with the dimensions described with respect to FIG. 4. Anchor wire 30 also includes three grooves, 42, 43, and 44, formed in the bottom 41 of anchor wire 30. The dimensions of the bottom grooves match the dimensions of the top grooves, and each bottom groove is symmetrically aligned with a corresponding top groove along center line 110.

Figure 6:
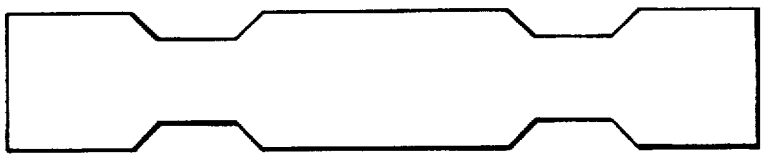
FIG. 6 is a cross-sectional view of yet another embodiment of an anchor wire of the present invention.
Figure 7:
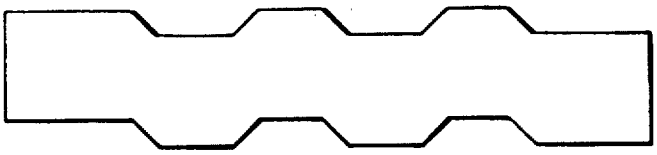
FIG. 7 is a cross-sectional view of still another embodiment of an anchor wire of the present invention.
Figure 8:
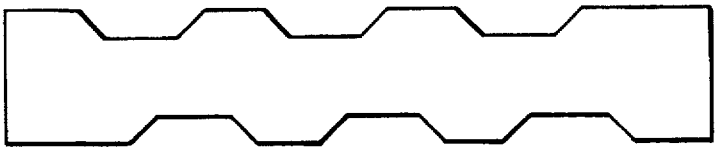
FIG. 8 is a cross-sectional view of a further embodiment of an anchor wire of the present invention.

FIGS. 6–8 show three other embodiments of anchor wires of the present invention including fewer grooves (FIG. 6) and varyingly offset grooves on the top and bottom surfaces (FIGS. 7–8).

Figure 9:
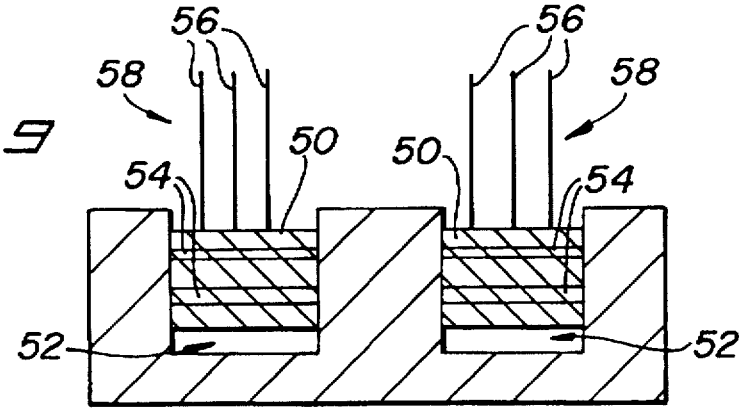
FIG. 9 is a cross-sectional view of a brush employing an anchor wire of the present invention with one-half of the tuft removed.

In use; as shown in FIG. 9, an anchor wire is cut into staples 50 which are driven into the tuft holes 52 with the grooves 54 transverse to the direction of the longitudinal axis of the bristles 56. The grooves 54 significantly increase the retention of the tufts 58 within the tuft holes 52 as shown, by way of example, in tests conducted for tuft retention in sample toothbrushes of two types of plastic (Propionate and Polypropylene) the result of which is set forth in Table I, below.

TABLE I

| | Flat Wire | Single-Sided Grooved Wire | Double-Sided Grooved Wire |
|---|---|---|---|
| | PROPIONATE | | |
| Average (lbs of force) | 5.50 | 6.59 | 8.15 |
| % Increase | 0.0% | 19.8% | 48.2% |
| | POLYPROPYLENE | | |
| Average (lbs of force) | 4.99 | 6.67 | 9.12 |
| % Increase | 0.0% | 33.7% | 82.8% |

The improvement in tuft retention is based on the interaction between the grooves and the material defining the tuft holes. When a staple is driven into the tuft holes, as shown in FIG. 9, it extends beyond the tuft holes 52 into the surrounding material. When the material defining the tuft holes is plastic, the cold flow of the plastic forces material into the grooves of the wire. This improves staple retention and correspondingly, tuft retention. Obviously, with the use of any other material which is subject to cold flow, this type of improvement can be realized.

With use of the present invention, an improvement in bristle retention may also occur. When there are sufficient bristles no crowd the tuft hole after application of the staple, the grooves in the staple act to crimp the bristles at the loop base and establish a matrix of intersection points between the bristles and the grooves to thereby increase the force necessary to remove an individual bristle.

Variations of groove shape, depth, width, number, location etc., are considered a part of the present invention and while reference has been made to certain embodiments, materials and configurations, modifications could be made by one of skill in the art without departing from the spirit or intent of the invention.

I claim:

1. A brush with improved tuft retention comprising:

a handle;

a head made from a material subject to cold flow, connected to said handle, and having a plurality of tuft holes therein;

at least one bristle anchored in each said tuft hole with a multi-sided staple, wherein each said staple has at least one longitudinal groove in at least one side, each groove extending substantially along the entire length of the staple, wherein each said staple is oriented such that at least one groove in each said staple is transverse to the longitudinal axis of the bristles when said staple is used to anchor bristles in one of said plurality of tuft holes, and wherein said head material cold flows into at least one of said plurality of longitudinal grooves.

2. A brush according to claim 1, wherein said each staple has at least one groove on a first side and a at least one groove on a second opposite side.

3. A brush according to claim 2, wherein the grooves on said opposite sides are diametrically opposed.

4. A brush according to claim 2, wherein the grooves on said opposite sides are horizontally offset with respect to each other.

5. A brush according to claim 1, wherein at least one of said grooves has a bottom and two side walls.

6. A brush according to claim 5, wherein said side walls of said at least one groove are at oblique angles to said bottom of said at least one groove.

7. A brush according to claim 1, wherein the length of each said staple is greater than the diameter of each said tuft hole such that each said staple is anchored by its penetration of the material of the head surrounding each said tuft hole, wherein after said staple is driven into said tuft hole and said surrounding material, said material flows into the grooves of each said staple to provide a stronger attachment of said staples to said brush.

8. A brush according to claim 1, wherein said brush includes a plurality of bristles anchored in each said tuft hole such that each said tuft hole is substantially filled with said bristles and said anchor causing said bristles to be crimped against the transverse grooves in said staple to thereby provide a matrix of intersecting points between at least a portion of said bristles and said staple to create a plurality of anchor points for said bristles in each said tuft hole.

9. A brush according to claim 1, wherein said brush is a toothbrush.

10. A brush according to claim 9, wherein said staple is made from a nickel-silver alloy.

11. A multi-sided anchor wire, used to form staples for anchoring tufts of bristles in tuft holes in a brush, said wire having a plurality of spaced apart grooves each groove extending substantially along the entire length of said wire and formed in at least one side of said wire, wherein said grooves are parallel to the longitudinal axis of said wire and wherein said grooves are oriented transversely to the longitudinal axis of the bristles when said wire is used in the form of a staple to anchor said bristles in said tuft holes.

12. An anchor wire according to claim 11, wherein said grooves are formed in at least two sides of said multi-sided anchor wire.

13. An anchor wire according to claim 12, wherein said grooves are formed on opposite sides of said multi-sided anchor wire.

14. An anchor wire according to claim 12, wherein said grooves are directly, diametrically opposed from each other on opposite sides of said wire.

15. An anchor wire according to claim 12, wherein said grooves are horizontally offset from each other on opposite sides of said wire.

16. An anchor wire according to claim 11, wherein at least one of said grooves has a bottom and two side walls.

17. An anchor wire according to claim 16, wherein said side walls of at least one groove are at oblique angles to said bottom of said at least one groove.

18. A method of securely anchoring bristles to brushes comprising the steps of:

providing a brush, having a head made from a material subject to flow, wherein said head has a plurality of tuft holes therein;

driving multi-sided staples, each said staple having at least one longitudinal groove on at least one side and each groove extending substantially along the entire length of the one side, into said tuft holes, to anchor at least one bristle in each said tuft hole, wherein said staples are of a length larger than the diameter of said tuft hole such that said staples are driven into the material of the head surrounding said tuft holes and wherein said staples are oriented such that their grooves are transverse to the longitudinal axis of the bristle(s) anchored thereby; and allowing the material to flow into the grooves of said staples to more firmly retain the staples in the head.

19. A method according to claim 18, further comprising the steps of substantially filling each said tuft hole with bristles such that when said bristles are driven into said tuft hole said bristles are crimped against the transverse grooves of said staple to thereby provide a matrix of intersecting points between at least a portion of said bristles and said staple to establish a plurality of anchor points for said bristles.

20. A brush with improved tuft retention comprising:

a handle;

a head made from a material subject to cold flow, connected to said handle, and having a plurality of tuft holes therein;

a plurality of staples, wherein each of said plurality of staples has at least one side with at least one longitudinal groove defined by a pair of raised walls;

at least one bristle anchored in each said tuft hole with one of said plurality of staples, wherein said one of said staples is positioned such that the grooves in said one of said staples are transverse to the longitudinal axis of the bristles and wherein after said one of said staples is driven into one of said tuft holes said material flows into the at least one groove on each of said staples and wherein at least one of said raised walls defining said at least one groove contacts the at least one bristle.

* * * * *